US009598882B2

(12) United States Patent
Prat et al.

(10) Patent No.: US 9,598,882 B2
(45) Date of Patent: Mar. 21, 2017

(54) DEVICE WITH DETECTION, SIGNALLING AND INFORMATION TAG AND TAG DETACHER FOR SUCH A DEVICE

(71) Applicant: SOLEXXM, Chanteloup-en-Brie (FR)

(72) Inventors: Lionel Prat, Chelles (FR); Jean-Marie Boutonnet-Tranier, Rosny-sous-Rosny (FR)

(73) Assignee: SOLEXXM (FR)

( * ) Notice: Subject to any disclaimer, the term of this patent is extended or adjusted under 35 U.S.C. 154(b) by 147 days.

(21) Appl. No.: 14/367,503

(22) PCT Filed: Dec. 20, 2012

(86) PCT No.: PCT/IB2012/057537
§ 371 (c)(1),
(2) Date: Jun. 20, 2014

(87) PCT Pub. No.: WO2013/093839
PCT Pub. Date: Jun. 27, 2013

(65) Prior Publication Data

US 2015/0070171 A1 Mar. 12, 2015

(30) Foreign Application Priority Data

Dec. 23, 2011 (FR) ..... 11 62371

(51) Int. Cl.
*E05B 73/00* (2006.01)
*G08B 13/24* (2006.01)

(52) U.S. Cl.
CPC ..... *E05B 73/0017* (2013.01); *E05B 73/0052* (2013.01); *G08B 13/2434* (2013.01)

(58) Field of Classification Search
None
See application file for complete search history.

(56) References Cited

U.S. PATENT DOCUMENTS 2,411,987 A * 12/1946 Antonio ..... A44C 3/001 40/1.5
4,000,543 A 1/1977 Paskert
(Continued)

FOREIGN PATENT DOCUMENTS

| | | |
|---|---|---|
| EP | 0132531 | 2/1985 |
| WO | 9409235 | 4/1994 |
| WO | 9731170 | 8/1997 |

OTHER PUBLICATIONS

Translation of Written Opinion of the International Searching Authority for PCT/IB2012/057537.
(Continued)

*Primary Examiner* — Quan-Zhen Wang
*Assistant Examiner* — Rajsheed Black-Childress
(74) *Attorney, Agent, or Firm* — The Belles Group, P.C.

(57) ABSTRACT

Device for protecting an article against theft and/or for identifying it, comprising a tag (B) with a passage able to accept a metal pin (F, 8) passing through the item or attached to a lanyard surrounding the item, the tag comprising means (E) for locking the pin in the passage and preventing it from being extracted without a detacher being present, a first face (1a) of the tag which face faces towards the pin being essentially planar, it being possible for the pin to be attached to a head (K), the size of which corresponds to that of the first face of the tag; the tag (B) has a peripheral flank (2) equipped with a translational-guidance means (2) able to collaborate with a cylindrical guide surface provided in a housing (3) of the detacher, and the second face (1) of the tag, remote from the head of the pin, is planar and essentially parallel to the first face.

12 Claims, 2 Drawing Sheets

(56) References Cited

U.S. PATENT DOCUMENTS

| | | | | |
|---|---|---|---|---|
| 2005/0128087 | A1* | 6/2005 | Claessens | G06Q 20/207 340/572.8 |
| 2008/0258479 | A1* | 10/2008 | Lopez | E05B 73/0017 292/251.5 |
| 2008/0303675 | A1* | 12/2008 | Hogan | E05B 73/0017 340/572.8 |
| 2009/0058659 | A1* | 3/2009 | Handyside | G08B 15/02 340/572.9 |
| 2009/0064734 | A1* | 3/2009 | Zinner | E05B 73/0017 70/57.1 |
| 2009/0139279 | A1* | 6/2009 | Garner | E05B 17/2015 70/57.1 |
| 2009/0224918 | A1* | 9/2009 | Copeland | E05B 73/0017 340/572.1 |
| 2010/0187305 | A1* | 7/2010 | Holcomb | E05B 73/0017 235/385 |

OTHER PUBLICATIONS

International Search Report in International Application PCT/IB2012/057537 mailed Mar. 1, 2013.

* cited by examiner

DEVICE WITH DETECTION, SIGNALLING AND INFORMATION TAG AND TAG DETACHER FOR SUCH A DEVICE

PRIORITY

Priority is claimed as a national stage application, under 35 U.S.C. §371, to international application No. PCT/IB2012/057537, filed Dec. 20, 2012, which claims priority to French application FR1162371, filed Dec. 23, 2011. The disclosures of the aforementioned priority applications are incorporated herein by reference in their entirety The present invention relates to a device for protecting an article against theft, and/or identifying it, of the kind which comprise a badge with passage suitable for receiving a metal pin which passes through the article or which is attached to a lanyard surrounding the article, the badge comprising means for locking the pin in the passage and preventing its extraction without a detaching appliance, a first face of the badge turned toward the pin being essentially planar, the pin being able to be securely attached to a head with an extent that corresponds to that of the first face of the badge.

The badge and the metal fixing pin provide protection for the articles against theft. This badge and this pin also serve as signaling and information element.

The term "metal pin" should be understood in a very broad sense to designate a rod or a cylindrical or prismatic metal element, with a free end that is generally pointed.

For a number of years now, systems for protecting articles in stores against theft have been expanded. The principle of these systems is based on a protection badge containing an electronic circuit which is detected on leaving the store when it is located between two detection antennas.

A portion of the article is positioned and captured between the badge and a security pin.

The badge contains a locking system into which the security pin with a large head is inserted by pressure. The locking system in particular may comprise a passage for receiving the pin between balls thrust toward one another by a spring in order to jam the pin if extraction is attempted.

The customer must go to the store checkout for the checkout operator to release the pin (and thus the clothing) by means of a detacher which comprises magnets for attracting the balls and separating them.

The customer can then leave the store with his or her article without triggering an alarm when passing between antennas at the exit.

If the customer leaves the store without having the badge removed from the article, the latter triggers an alarm when it passes between the antennas.

The positioning of the badges currently known in the detaching appliance is not entirely satisfactory, and slants can occur that are unfavorable to an easy releasing of the pin. Furthermore, it is not easy to display information on the badge.

The aim of the invention is, above all, to provide a device of a badge and pin of the kind defined previously, which no longer presents, or does so to a lesser degree, the drawbacks recalled above.

According to the invention, a device for protecting an article against theft, and/or identifying it, of the kind defined previously, is characterized in that the badge has a peripheral flank provided with a translational guiding means suitable for cooperating with a cylindrical or prismatic conjugate guiding surface, provided in a housing of the detaching appliance, and the second face of the badge, distant from the head of the pin, is planar, essentially parallel to the first face and orthogonal to the direction of the translation.

Preferably, the peripheral flank of the badge is cylindrical or prismatic and constitutes the translational guiding means in a direction parallel to the generatrices of the peripheral flank.

The peripheral flank, in particular cylindrical or prismatic, can comprise at least one rim protruding transversely, according to a contour designed to closely follow the conjugate guiding surface, and constituting the translational guiding means.

The second face of the badge can be surrounded by a rim protruding in a direction orthogonal to this second face, this rim determining a recess designed to receive a tag of a thickness less than the height of the rim, which thus protects the tag.

The flank of the badge can have a peripheral recess, between rims protruding transversely, designed to receive a tag of a thickness less than the transverse protrusion of the rims, this tag surrounding, at least partially, the badge.

Advantageously, the face of the head of the pin situated on the side opposite the badge is flat. This flat face of the head of the pin can be surrounded by a rim protruding in a direction orthogonal to said flat face, determining a recess designed to receive a tag of a thickness less than the height of the rim.

The face of the head of the pin turned toward the badge can be surrounded by a rim protruding in a direction orthogonal to this face, over a distance at least equal to the height of a mounting plate surrounding the base of the pin, so as to determine a recess designed to receive an RF or RFID electronic detection circuit.

The peripheral wall of the badge can be surrounded, on its edge turned toward the head of the pin, by a rim protruding at least partly in a radial direction, facilitating the gripping of the badge installed in a detaching appliance, and its manual extraction.

The face of the head of the pin distant from the badge and the face of the badge distant from the head of the pin can be provided with a tag, in particular identical.

Advantageously, the face of the badge distant from the head of the pin is provided with a digital screen protected by a peripheral rim of this face.

The invention also relates to a detaching appliance for a device as defined previously, characterized in that it comprises a cylindrical housing conjugate with the guiding means of the peripheral flank of the badge, to ensure its guidance when it is fitted, the bottom of the housing of the appliance being flat, and a system of permanent magnets, arranged in this appliance for the releasing of the pin, develops a magnetic field of at least 15 000 gauss, preferably between 15 000 and 20 000 gauss.

Other features and advantages of the invention will become apparent from the following description with reference to the attached drawings, which is in no way limiting. In these drawings.

Figure 1:
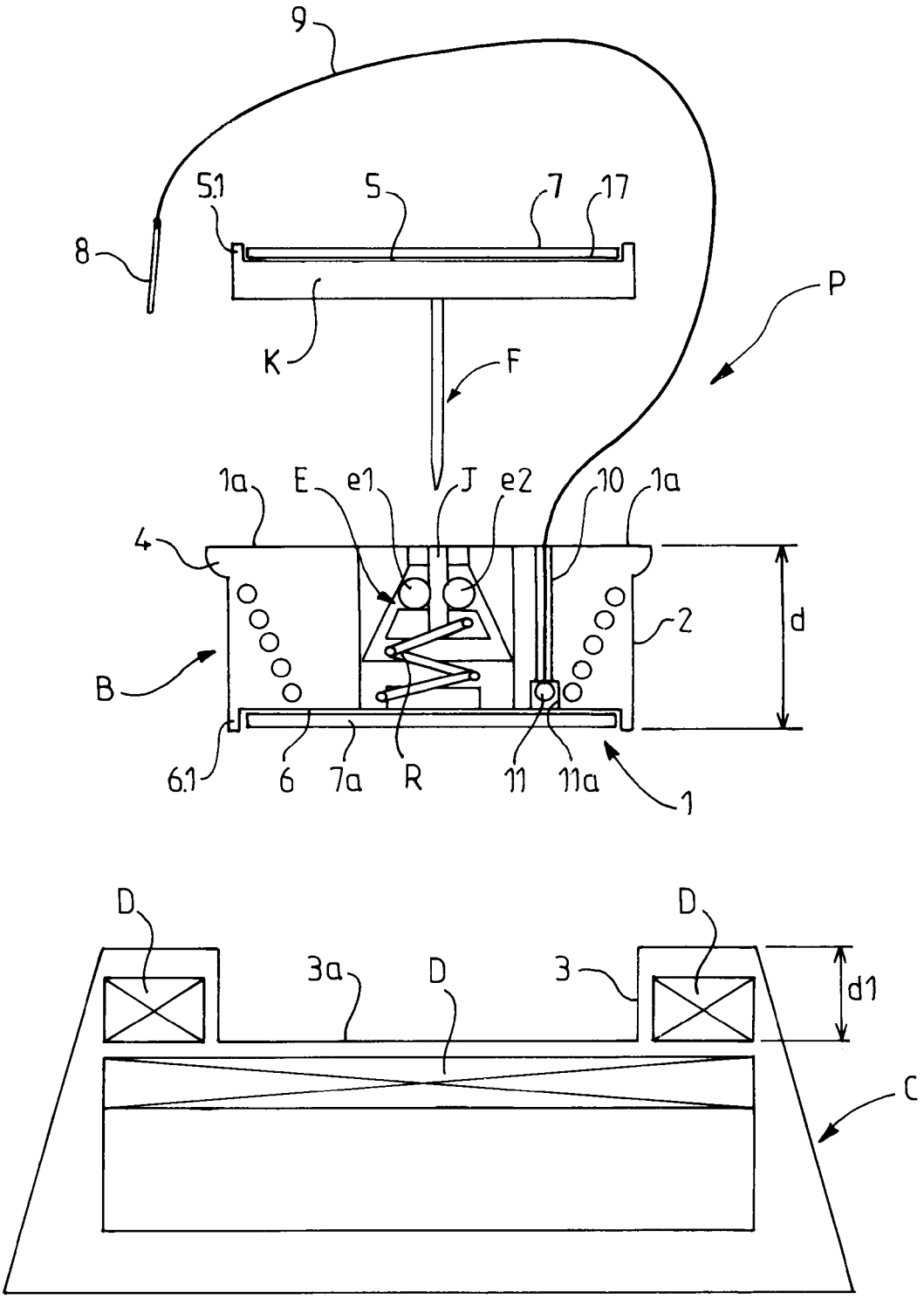
FIG. 1 is a schematic vertical cross section of a device for protecting an article against theft, according to the invention, the pin not being engaged in the passage of the badge, which is represented above the housing of the detaching appliance.
Figure 2:
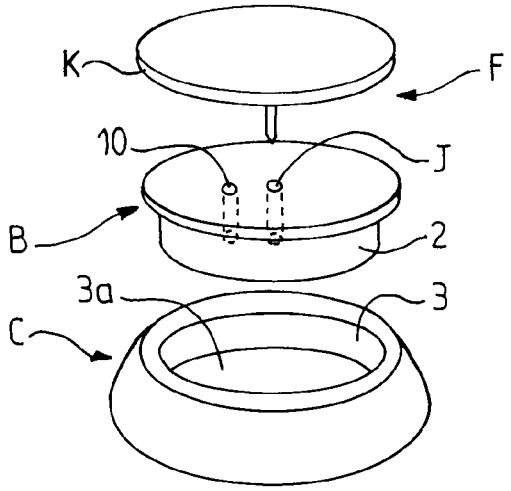
FIG. 2 is a perspective schematic representation, on a smaller scale, of the pin, the badge and the detaching appliance.

Referring to FIG. 1, a device P can be seen for protecting an article (not represented) against theft, comprising a badge B with passage J, emerging on a first face 1*a*. The passage J is suitable for receiving a metal pin F designed to pass through the article, or a pin 8 which is attached to a lanyard 9 designed to surround a part of the article. The badge B comprises means, forming a lock E, for locking the pin F or 8 in the passage J and preventing its extraction without a detaching appliance C, referred to more simply by the term "detacher". The lock E comprises balls e1, e2, bearing against inclined surfaces converging toward one another under the thrust of a spring R in order to jam the pin between the balls if an extraction is attempted.

The pin F is securely attached to a head K. The first face 1*a* of the badge turned toward the head K of the pin is essentially planar, and the extent of the head F of the pin corresponds to that of this first face 1*a*.

The flank 2 of the badge B is cylindrical, and the second face of the badge, distant from the head of the pin, constitutes a base 1 which is flat.

The detacher C comprises a cylindrical housing 3. For the fitting of the badge B in this housing, the flank 2 constitutes a translational guiding means cooperating with the internal cylindrical surface of the housing 3. The cylindrical flank 2 slides inside the edges of the housing 3 of the detacher C, which stably positions the badge B in the detacher C. The badge B is flat in contact with the detacher C when the pin F is to be released from the badge B.

As a variant, the flank 2 could be prismatic.

A set of permanent magnets D is situated in the detacher C to attract and separate the balls of the lock E situated in the badge B. The pin F is then released.

A transversely protruding peripheral rim 4 is provided around the first face 1*a* of the badge B. This rim 4 makes it possible to manually grip the badge B and remove it against the attraction force of the detacher C. The height d of the badge is approximately two times greater than the depth dl of the recess 3. The badge B is thus easy to grasp.

In the systems that currently exist involving detachers with strong power on badges with non-protuberant lock, the badge risks being positioned askew because of the design of the locking mechanism when the latter is attracted by the magnet of the detacher. This makes it less easy to keep the badge in the right position in the detacher and the pin is more difficult to remove.

These drawbacks disappear with the device of the invention by virtue of the translational guiding and of the flat base 1.

The base 1 of the badge B of the present invention, including the part to be unlocked by the magnetic detacher C, is wider than most of the badge bases currently existing on the market. This wider base will therefore not be able to enter into currently existing detachers, and the badges of the present invention will therefore not be able to be detached from their pin with most of the current detachers. It will be necessary to have a detacher according to the present invention to release the pin of the badge. Because of the large dimension of the base 1, the magnets of the detacher C are relatively distant from the lock E and have to develop a high magnetic field, greater than 15 000 gauss. A detacher according to the invention preferably develops a magnetic field of between 15 000 and 20 000 gauss.

A detacher C according to the present invention, by its shape and its power, will be able to detach most of the badges on the article protection market.

The flat face 17 of the head K of the pin situated on the side opposite the badge is surrounded by a rim 5.1 protruding in a direction orthogonal to this flat face, determining a recess 5 designed to receive a tag 7, preferably self-adhesive, of a thickness less than the height of the rim 5.1, which confers protection on the tag.

The second face 1 of the badge is advantageously surrounded by a rim 6.1 protruding in a direction orthogonal to this second face. This rim 6.1 determines a recess 6 designed to receive a tag 7*a* of a thickness less than the height of the rim 6.1, which thus protects the tag.

The recess 6 of the badge is advantageously of the same size as that of the head K of the pin so that it is possible to use tags 7, 7*a* of the same size which will result in production cost savings. Advantageously, the tag 7*a* is identical to the tag 7.

The recess 5 of the flat face of the head K of the pin F, as well as that 6 of the badge B, make it possible to position a marking tag 7, 7*a*, or a tag with logo or with information.

Once the tag 7*a* is fitted, its surface remains set back from the crown of the rim 6.1 which makes it possible, when positioning the badge B in the detacher C, for the tag 7*a* not to rub against the bottom 3*a* of the detacher C. This arrangement makes it possible to avoid a wear phenomenon due to the rubbing of the tag 7*a* on the detacher over repeated reuses of the badge in detaching operations.

According to a variant, it is possible to position, in this recess 6, in place of the tag 7*a*, a miniature digital screen whose electronic part and memory are located inside the badge B. This screen, also protected by the rim 6.1, can display photos, messages, price indications, or any other information.

The digital screen with its power supply and electronics part inside the badge, can be wirelessly linked with a remote database to broadcast all types of information.

The recesses 5, 6 of the head of the pin and of the badge allow for a good protection of the tags against wear by friction. This also avoids the need to have to position, above the tags, a cap of transparent plastic material, in the manner of the old key fobs, and thus makes it possible to ensure a lesser thickness of the badge and of the pin head. This also avoids additional material and manpower costs.

The fact of having one and the same tag positioned on the pin head and on the opposite face of the badge simultaneously, makes it possible to have a recto-verso visual on the badge and the pin once the latter are positioned on the articles to be protected or to be signaled.

When fitting the badges on the articles, the badges are generally positioned with the pin side inside the article and the badge outside the article; in this way, the article can be more easily tried on, notably if it is a clothing item or footwear or other article of this kind. The public can therefore generally see the tag which is positioned on the badge when the article is exposed. If, through a manipulation error on the part of the person fitting the badge, or if, for any reason, the badge is positioned inside the article, according to the present invention, the public would also be able to see the tag positioned on the pin which is, in this case, located on the external side of the article.

In order to allow for a different means of fixing the articles between the pin and the badge, a duct 10 is formed inside the badge, and passes through it. A lanyard, in particular a rope 9, can be inserted into the duct 10 of the badge. This rope is provided with a protuberance 11 at one of its ends. This protuberance 11 is locked in a cavity 11*a* at the contraction formed by the inlet of the duct 10 which emerges in the cavity. The cavity 11*a* and the protuberance 11 are masked by the tag 7*a*.

The other end of the rope consists of a pin point 8.

This pin point 8 and this rope 9 can pass through an article (the handle of a utensil, a belt hoop, etc.). The pin point 8 is then positioned in the lock E of the badge, in place of the pin F. The article is thus secured to the badge and the cable and is thus protected.

Figure 3:
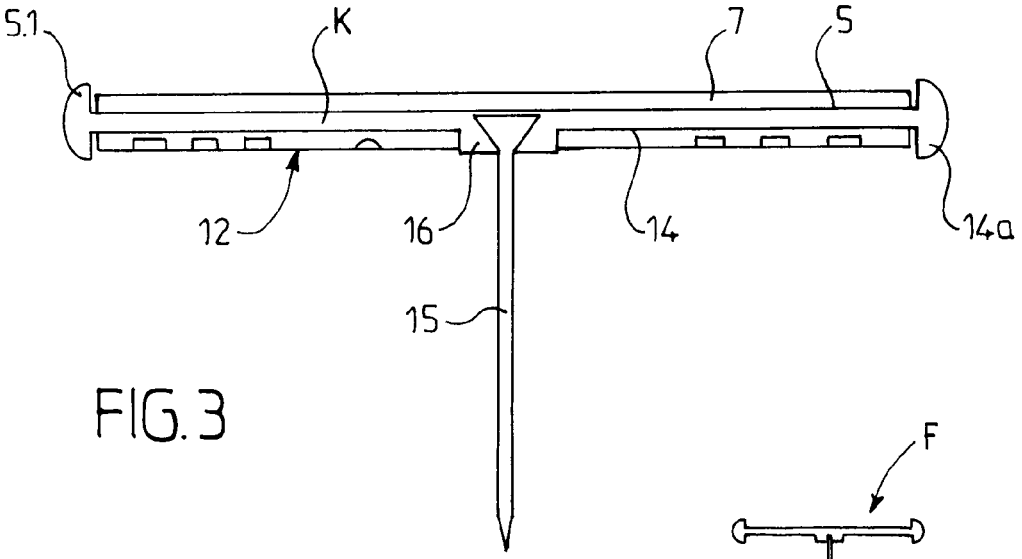
FIG. 3 is a schematic representation in vertical cross section of a variant of the pin and its head, with simple or RF or RFID self-adhesive tags, positioned on each side of the pin.

According to the variant of FIG. 3, the metal part 15 of the pin F is secured to the pin head K made of plastic material by a molding of the top part thereof in a mounting plate 16, or coating, situated on the face of the head K turned toward the badge. The length of the part 15 takes account of the thickness of the wall of the article to be passed through for the point of the part 15 to come in proximity to the bottom of the passage J of the badge, without abutting against this bottom.

The face of the head K of the pin, provided to be turned toward the badge B, is surrounded by a rim 14*a* (FIG. 3) protruding in a direction orthogonal to this face, over a distance at least equal to the height of the mounting plate 16 surrounding the base of the pin, so as to determine a recess 14 designed to receive an RF (radio frequency) or RFID (radio frequency identification) electronic detection circuit 12.

The electronic detection circuit 12 is advantageously a self-adhesive circuit. The recess 14 in which the RF or RFID electronic circuit is located protects and conceals the latter.

These detection circuits are used for the detection of articles being stolen, or for the identification of these articles for the purposes of management, of the fight against counterfeiting, or for the traceability of the articles, or for any other application appropriate to the invention.

The fact that the electronic circuit 12 is located under the head K of the pin, therefore between the base of the head of the pin and the article (not represented), notably the clothing item, this confers on it a better positioning for its protection against impacts, vandalism or neutralization attempts. In practice, in the systems where the electronic detection circuits are located on the external face of the head K, even protected by a cap, these circuits are more easily identifiable and neutralized.

The bottom rim 14*a* of the head of the pin makes it possible to prevent access by a tool aiming to sabotage the securing of the article. This or these bottom rim(s) reinforce the rigidity of the head of the pin.

Figure 4:
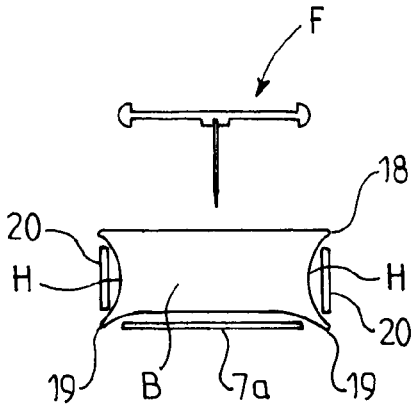
FIG. 4 is a vertical schematic cross section, on a smaller scale, of a variant of the badge and of the pin.

A slight rim 18 (FIG. 4), protruding transversely, around the top part of the badge, makes it possible to grasp the latter when it is located in the detacher and facilitates its extraction because the badge, attracted by the magnet E of the detacher, is glued to the latter.

Around the base 1 of the badge, a rim 19 (FIG. 4) of a height slightly greater than the thickness of the tag 7*a*, can be provided to protrude equally in the transverse or radial direction.

On the cylindrical flank H of the badge, a tag 20 can be positioned making it possible to see information situated on a surface with generatrices that are vertical by comparison to the horizontal planes of the other two tags 7, 7*a*.

The latter tag 20 is protected in the same way as the tag 7*a* by the two rims 18 and 19 protruding transversely, or radially, which are located at each end of the badge. The rims 18, 19 determine between them a cylindrical recess in which the tag 20 is fitted. The rim 19 constitutes the translational guiding means of the badge when it is introduced into the housing 3 of the detacher.

The badge and its pin constitute an assembly that is totally flat on both faces, and clothing items stacked one on top of the other are not unbalanced relative to one another. The stack of articles remains straight.

If the pin with its head is positioned outside the clothing item in order for the logo of the pin to be visible, the badge is then inside the clothing item. When a person tries on the clothing item by slipping his or her arms into the sleeve of a jacket or his or her leg into a pair of trousers, he or she systematically strikes the tag with risks of injury or damage to the weave of the clothing item. According to the invention, the head can be positioned inside since the badge also comprises the logo.

Furthermore, if the logo were present only on the head of the pin and if the latter were located inside the clothing item, the announcement effect of the logo message would be nonexistent, since this logo would not be visible.

The invention claimed is:

1. A device for protecting an article against theft, and/or identifying it, comprising a badge with passage suitable for receiving a metal pin which passes through the article or which is attached to a lanyard surrounding the article, the badge comprising means for locking the pin in the passage and preventing its extraction without a detaching appliance, a first face of the badge turned toward the pin being essentially planar, the pin being able to be securely attached to a head with an extent that corresponds to that of the first face of the badge, wherein the badge has a peripheral flank provided with a translational guiding means suitable for cooperating with a cylindrical or prismatic conjugate guiding surface, provided in a housing of the detaching appliance, and a second face of the badge, distant from the head of the pin, is planar, essentially parallel to the first face, wherein the peripheral flank comprises first rims, which protrude transversely from the flank according to a contour designed to closely follow the conjugate guiding surface, and which constitute the translational guiding means, and wherein the peripheral flank of the badge has a peripheral recess, bounded by two of the first rims, designed to receive a first identifying tag of a thickness less than the transverse protrusion of the first rims, the first identifying tag surrounding, at least partially, the badge.

2. The device as claimed in claim 1, wherein the peripheral flank of the badge is cylindrical or prismatic and constitutes the translational guiding means in a direction parallel to the generatrices of the peripheral flank.

3. The device as claimed in claim 1, wherein the second face of the badge is surrounded by a second rim protruding in a direction orthogonal to this second face, this second rim determining a second recess designed to receive a second identifying tag of a thickness less than the height of the second rim, which thus protects the second identifying tag.

4. The device as claimed in claim 1, wherein the face of the head of the pin situated on the side opposite the badge is flat.

5. The device as claimed in claim 4, wherein the flat face of the head of the pin situated on the side opposite the badge is surrounded by a third rim protruding in a direction orthogonal to this flat face, determining a third recess designed to receive a third identifying tag of a thickness less than the height of the third rim.

6. The device as claimed in claim 1, wherein the face of the head of the pin turned toward the badge is surrounded by a fourth rim protruding in a direction orthogonal to this face, over a distance at least equal to the height of a mounting plate surrounding the base of the pin, so as to provide a recess to receive a radio frequency (RF) identifying tag.

7. The device as claimed in claim 1, wherein the peripheral wall of the badge is surrounded, on its edge turned toward the head of the pin, by a fifth rim protruding in a radial direction, facilitating the gripping of the badge installed in a detaching appliance, and its manual extraction.

8. The device as claimed in claim 1, wherein the face of the head of the pin distant from the badge and the face of the badge distant from the head of the pin are each provided with an identical theft detection tag.

9. The device as claimed in claim 1, wherein the face of the badge distant from the head of the pin comprises a digital display screen protected by a peripheral rim of this face.

10. A detaching appliance for a device as claimed in claim 1, the appliance comprising a cylindrical housing conjugate with the guiding means of the peripheral flank of the badge, to assure its guidance when it is fitted, the bottom of the housing of the appliance being flat, and a set of permanent magnets, arranged in this appliance for the releasing of the pin, develops a magnetic field of between 15,000 and 20,000 gauss.

11. A device for protecting an article against theft, and/or identifying it, comprising a badge with passage suitable for receiving a metal pin which passes through the article or which is attached to a lanyard surrounding the article, the badge comprising means for locking the pin in the passage and preventing its extraction without a detaching appliance, a first face of the badge turned toward the pin being essentially planar, the pin being able to be securely attached to a head with an extent that corresponds to that of the first face of the badge, wherein the badge has a peripheral flank provided with a translational guiding means suitable for cooperating with a cylindrical or prismatic conjugate guiding surface, provided in a housing of the detaching appliance, and a second face of the badge, distant from the head of the pin, is planar, essentially parallel to the first face, wherein the face of the head of the pin turned toward the badge is surrounded by a first rim protruding in a direction orthogonal to this face, over a distance at least equal to the height of a mounting plate surrounding the base of the pin, so as to provide a recess to receive a radio frequency (RF) identifying tag.

12. A device for protecting an article against theft, and/or identifying it, comprising a badge with passage suitable for receiving a metal pin which passes through the article or which is attached to a lanyard surrounding the article, the badge comprising means for locking the pin in the passage and preventing its extraction without a detaching appliance, a first face of the badge turned toward the pin being essentially planar, the pin being able to be securely attached to a head with an extent that corresponds to that of the first face of the badge, wherein the badge has a peripheral flank provided with a translational guiding means suitable for cooperating with a cylindrical or prismatic conjugate guiding surface, provided in a housing of the detaching appliance, and a second face of the badge, distant from the head of the pin, is planar, essentially parallel to the first face, wherein the face of the head of the pin distant from the badge and the face of the badge distant from the head of the pin are each provided with an identical theft detection tag.

* * * * *